United States Patent [19]

Hutchins et al.

[11] Patent Number: 4,836,374

[45] Date of Patent: Jun. 6, 1989

[54] FITTED TOOL CASE

[75] Inventors: Walter J. Hutchins, West Hartford, Conn.; Randall K. Cooper, Kansas City, Mo.

[73] Assignee: The Stanley Works, New Britain, Conn.

[21] Appl. No.: 240,749

[22] Filed: Sep. 2, 1988

[51] Int. Cl.[4] ..... B65D 81/04; B65D 81/16

[52] U.S. Cl. ..... 206/373; 206/523; 206/592; 383/18; 383/24

[58] Field of Search ..... 383/18, 22, 24; 206/523, 373, 592

[56] References Cited

U.S. PATENT DOCUMENTS

| | | | |
|---|---|---|---|
| D. 175,722 | 10/1955 | Graham . | |
| 240,596 | 4/1881 | Laraway et al. . | |
| 845,390 | 2/1907 | Baughman et al. . | |
| 1,291,914 | 1/1919 | Kelley | 383/24 X |
| 1,356,815 | 10/1920 | Foresman . | |
| 1,566,041 | 12/1925 | Schaus . | |
| 1,646,632 | 10/1927 | Spinner . | |
| 1,709,685 | 4/1929 | Rothrock . | |
| 1,725,271 | 8/1929 | Hedman . | |
| 1,738,333 | 12/1929 | Szymanski . | |
| 1,756,135 | 4/1930 | Ruskin . | |
| 1,963,552 | 6/1934 | Horwitt . | |
| 2,126,407 | 8/1938 | Payne et al. . | |
| 2,228,493 | 1/1941 | Will . | |
| 2,341,600 | 2/1944 | Daniel . | |
| 2,387,790 | 10/1945 | Williamson . | |
| 2,587,559 | 2/1952 | Wetherbee . | |
| 2,699,865 | 1/1955 | Bowen . | |
| 2,746,081 | 5/1956 | Gershen . | |
| 2,797,806 | 7/1957 | Davis . | |
| 2,804,969 | 9/1957 | Barnett . | |
| 2,844,244 | 7/1958 | Hanson . | |
| 2,874,707 | 2/1959 | Koppel . | |
| 2,925,905 | 2/1960 | Metzler et al. . | |
| 3,013,656 | 12/1961 | Murphy, Jr. . | |
| 3,181,693 | 5/1965 | Freistat | 206/523 |
| 3,317,113 | 5/1967 | Humphrey . | |
| 3,327,841 | 6/1967 | Schurman et al. . | |
| 3,339,781 | 9/1967 | Schurman et al. . | |
| 3,367,483 | 2/1968 | Studen . | |
| 3,478,949 | 11/1969 | Richgels . | |
| 3,487,949 | 1/1970 | Merkle . | |
| 3,514,875 | 6/1970 | Howard . | |
| 3,755,925 | 9/1973 | Court . | |
| 3,777,882 | 12/1973 | McIntyre | 206/523 X |
| 3,831,805 | 8/1974 | Yonce . | |
| 3,878,939 | 4/1975 | Wilcox . | |
| 3,880,285 | 4/1975 | March | 206/373 |
| 3,899,072 | 8/1975 | Reinhart . | |
| 3,913,711 | 10/1975 | Schmid . | |
| 3,915,213 | 10/1975 | Graham, Jr. . | |
| 3,985,289 | 10/1976 | Prince . | |
| 3,987,895 | 10/1976 | Jamshidi . | |
| 4,002,233 | 1/1977 | Page, Jr. . | |
| 4,011,940 | 3/1977 | Neal et al. . | |
| 4,015,709 | 4/1977 | Millet . | |
| 4,029,202 | 6/1977 | Lasich et al. . | |
| 4,040,518 | 9/1977 | Carter . | |

(List continued on next page.)

*Primary Examiner*—William Price

[57] ABSTRACT

An attractive fabric covered fitted tool case includes a pair of platform members each having a multiplicity of pockets in their top wall to receive a multiplicity of tools, and relatively rigid support members under the platform members to provide structural support therefor. An elongated base sheet underlies the platform members and extends therebetween to provide a spacer section about which the platform members may be folded into abutting relationship in the closed position of the case. A fabric cover is provided on the outer surface of the base sheet and a releasable closure secures the tool case in closed position. The tool case may additionally include one or more pockets on its principal faces, and one of the pockets may include a pair of hanging rings which are pivotally mounted within a pocket so as to be able to be pivoted from a concealed position within the pocket to an exposed position for hanging the tool case.

19 Claims, 5 Drawing Sheets

U.S. PATENT DOCUMENTS

| | | | |
|---|---|---|---|
| 4,099,648 | 7/1978 | Kirkton . | |
| 4,106,597 | 8/1978 | Shook et al. | 206/523 X |
| 4,199,072 | 4/1980 | Jacks . | |
| 4,210,244 | 7/1980 | Westrick . | |
| 4,211,337 | 7/1980 | Weavers et al. . | |
| 4,220,252 | 9/1980 | Beall et al. . | |
| 4,225,038 | 9/1980 | Egly . | |
| 4,235,334 | 11/1980 | Ahn et al. . | |
| 4,289,235 | 9/1981 | Egly . | |
| 4,293,266 | 10/1981 | St. Lawrence et al. . | |
| 4,341,307 | 7/1982 | Shyers . | |
| 4,365,711 | 12/1982 | Long et al. . | |
| 4,373,628 | 2/1983 | Dantes . | |
| 4,407,410 | 10/1983 | Graetz et al. . | |
| 4,420,085 | 12/1983 | Wilson et al. . | |
| 4,428,481 | 1/1984 | Basili . | |
| 4,446,900 | 5/1984 | Markovich | 206/523 X |
| 4,449,629 | 5/1984 | Barrieau . | |
| 4,555,290 | 11/1985 | Graetz et al. . | |
| 4,573,575 | 3/1986 | Bergrath et al. . | |
| 4,586,615 | 5/1986 | Quitmann . | |
| 4,620,579 | 11/1986 | Lowe et al. | 206/523 X |
| 4,641,750 | 2/1987 | Johnson et al. . | |
| 4,658,567 | 4/1987 | Arada | 206/592 X |

FOREIGN PATENT DOCUMENTS

| | | | |
|---|---|---|---|
| 735443 | 5/1943 | Fed. Rep. of Germany | 383/18 |
| 3027024 | 2/1982 | Fed. Rep. of Germany . | |
| 3230987 | 2/1984 | Fed. Rep. of Germany . | |
| 3335558 | 4/1985 | Fed. Rep. of Germany . | |

FIG. 5
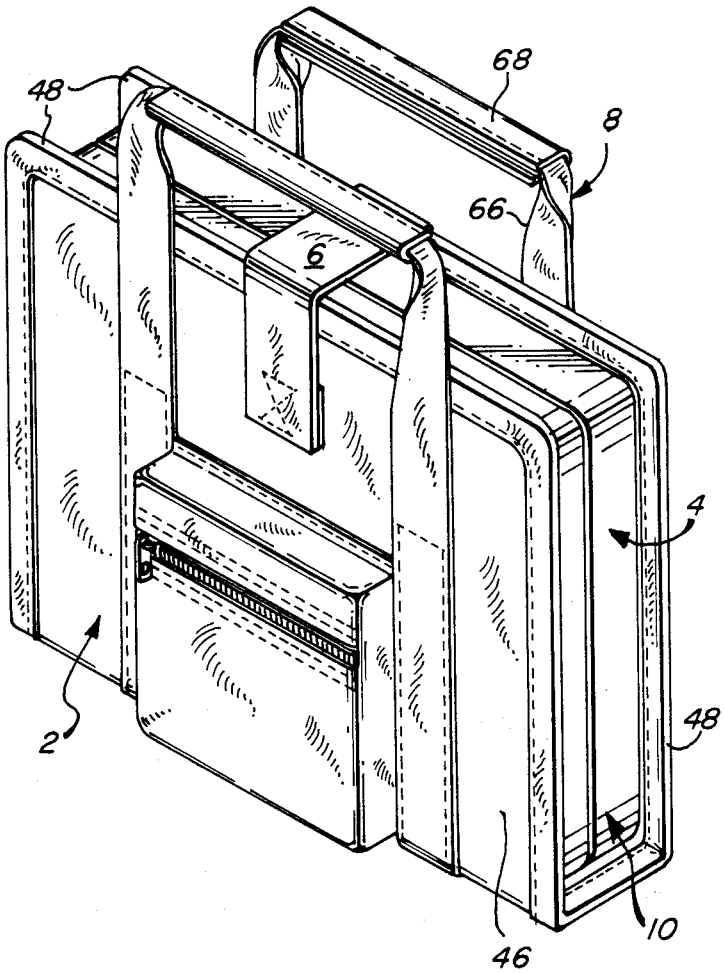
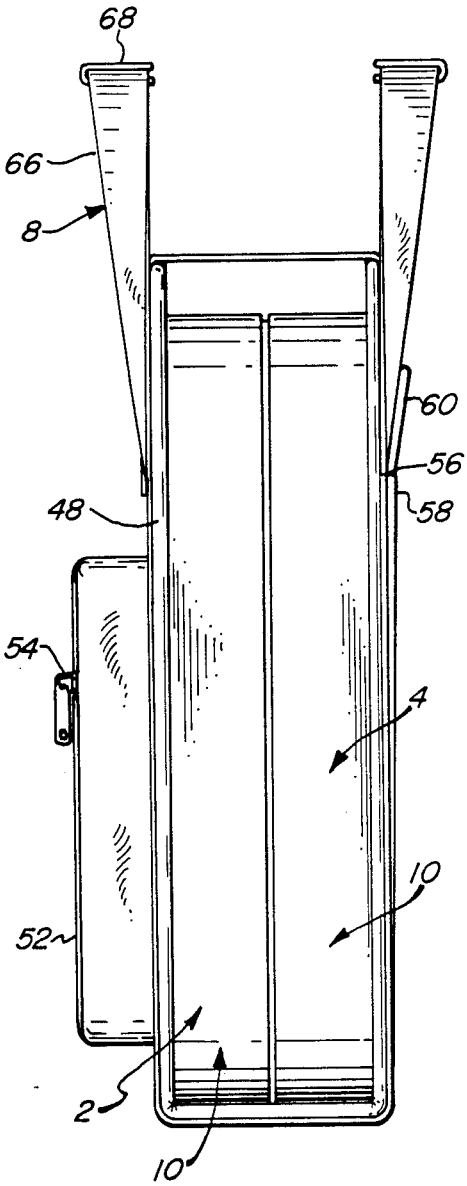
FIG. 6

FITTED TOOL CASE

BACKGROUND OF THE INVENTION

The present invention relates to tool carriers, and, more particularly, to fitted tool cases which may be readily carried and stored.

Various forms of tool carriers have been proposed for storing and carrying tools. The size of these tool boxes will vary considerably with the amount and nature of the tools to be carried. Moreover, the materials for such tool carriers have included metal fabrications for ruggedness, wooden tool boxes for economy and adaptability, and synthetic plastic fabrications for corrosion resistance and lightweight boxes. In the past, there have been fitted carriers for storing various types of specialized tools such as drafting tools and medical instruments; in these the tool case has recesses configured and dimensioned to receive the specialized tools which are stored therein.

However, there has remained a need for an attractive fitted tool case for carrying a variety of tools and related hardware to enable the homeowner or sportsperson to perform various repair and adjustment functions. Moreover, in the apartment setting in which many persons live, closed storage areas frequently are limited, and an attractive tool case presents the advantage of being able to be stored in an exposed living area.

It is an object of the present invention to provide a novel fitted tool case for storing a variety of tools for performing adjustment and repair functions and which is attractive in its appearance and relatively lightweight for transport purposes.

It is also an object to provide such a fitted tool case in which the tools are releasably retained within pockets therefor.

Another object is to provide such a tool case which may be readily assembled from readily fabricated components to provide a relatively durable structure.

A specific object is to provide such a tool case which has an outer fabric covering and a soft feel to its principal surfaces so as to present a highly attractive appearance and feel.

SUMMARY OF THE INVENTION

It has now been found that the foregoing and related objects may be readily attained in a fitted tool case including a pair of synthetic resin platform members each having a peripheral sidewall, a base flange about the lower end of the sidewall, and a transverse top wall extending across the top of the cavity peripherally defined by the sidewall. The top wall has a multiplicity of depending pockets formed therein which provide recesses configured and dimensioned to snugly receive a multiplicity of tools. The tool case also has a pair of support members of relatively rigid material seated snugly within the cavities of the platform members and having recesses in their upper surfaces closely conforming to the pockets of the platform members to provide support therefor.

Underlying the platform members is an elongated base sheet member which extends therebetween to provide a spacer section. The platform members are secured to the inner surface of the base sheet member and are spaced apart thereon a distance substantially equal to the combined height of the two platform members to permit the base sheet member to be folded about the spacer section to dispose the platform members in abutting relationship. A fabric covering is provided on the outer surface of the base sheet member and the covering, base sheet member and platform members are secured in assembly. Releasable closure means secures the tool case in closed position with the platform members in abutting relationship.

Preferably, a length of relatively thin and flexible synthetic resin sheet material is integrally formed to provide the platform members and a spacer section extending therebetween. The top walls of the platform members have upstanding ribs extending peripherally thereabout, and the rib on one member interfits with the rib on the other member in the abutting relationship thereof to effect functional engagement in the closed position of the tool case. The opposed surfaces of the upstanding ribs have cooperating detents and bosses which frictionally engage in the abutting relationship of the platform members to provide releasable retention means.

Desirably, the pockets in the top walls of the platform members have basewalls and sidewalls, and the pocket sidewalls have laterally inwardly projecting bosses to frictionally engage or overlie the tools seated therein for retention thereof within the pockets.

The tool case preferably includes a resiliently deflectable cushioning member disposed between the base sheet member and fabric member at least in the areas underlying the platform members to provide a relatively soft feel to the faces of the tool case.

In its usual form, the tool case additionally includes flexible fabric handle members secured to the fabric covering for each of the platform members and extending thereabove in the closed position of the tool case to provide a facile means for carrying the tool case. At least one pocket is secured to the fabric covering underlying one of the platform members, and this pocket has an opening adjacent its end spaced in the direction away from the spacer section and closure means for the opening of the pocket. Preferably, a pocket is provided on the fabric covering of each of the platform members, and these pockets have an opening adjacent the end spaced from the spacer section and releasable closure means for closing the opening of the pocket. One of the pocket members has the opening extending across its upper end, and a pair of hanging rings are pivotally supported in the pocket adjacent the opening for pivoting between a first position disposed within the pocket and a second position in which they extend upwardly therefrom for hanging the tool case upon a supporting structure.

Most desirably, the means securing the fabric covering, base sheet member and platform members in assembly includes stitching about the flanges which adds to the aesthetics of the case.

BRIEF DESCRIPTION OF THE DRAWINGS

FIG. 5 is a perspective view drawn to a reduced scale;

FIG. 6 is an end elevational view thereof, the opposite end elevational view being a mirror image thereof;

FIG. 11 is a perspective view of the tool case in an open position indicating in both phantom line and solid line pockets for seating tools and the like.

DETAILED DESCRIPTION OF THE ILLUSTRATED EMBODIMENTS

Turning first to FIGS. 1–6 of the attached drawings, therein illustrated is a portable tool case embodying the present invention and comprised of a pair of storage sections generally designated by the numerals 2,4 which are secured in their closed position by the fastener assembly generally designated by the numeral 6. A pair of handle straps generally designated by the numeral 8 enable the case to be comfortably carried by the user.

Figure 11:
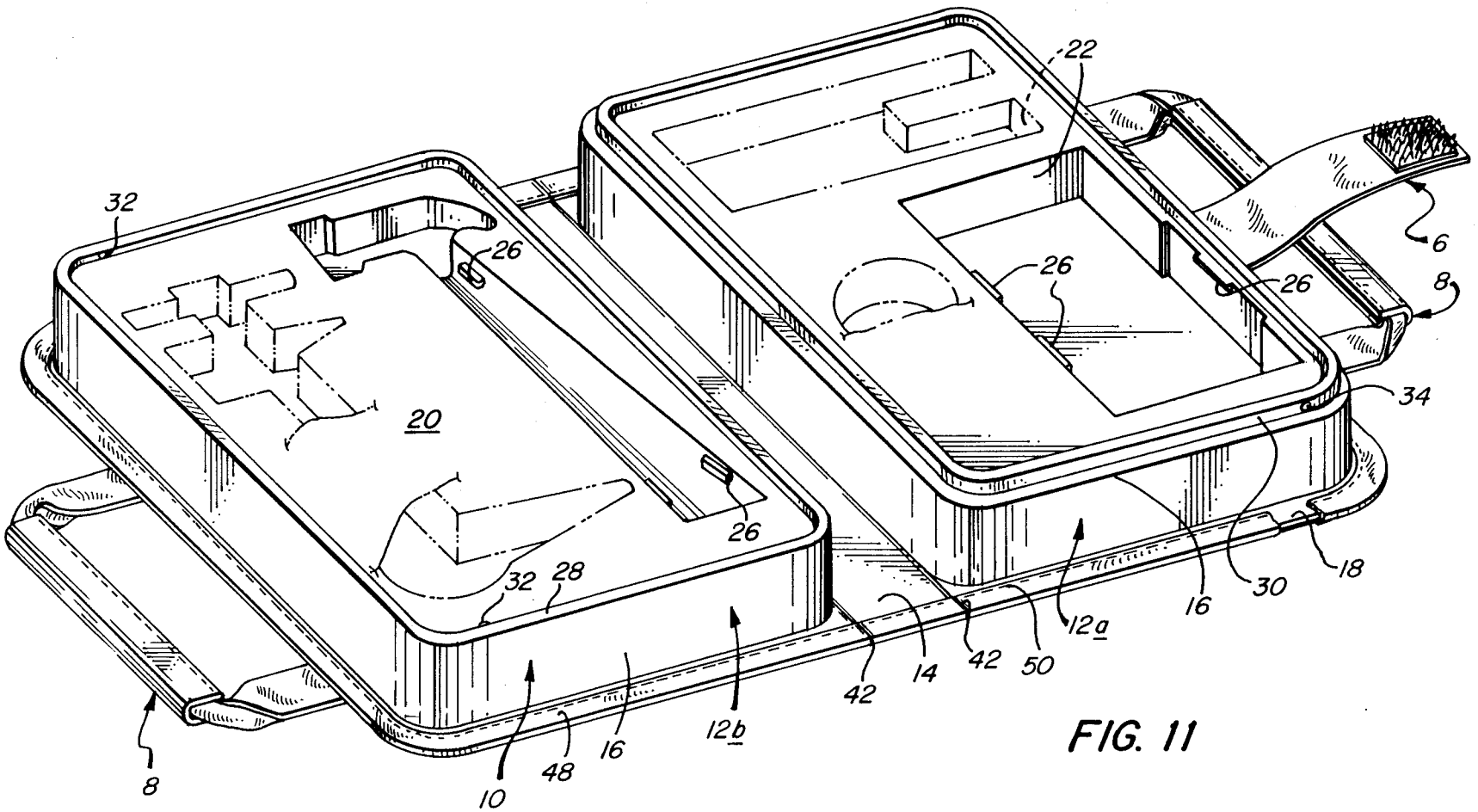

Turning now to FIGS. 7–11, the body of the case providing the storage sections is comprised of an assembly of series of members. As best seen in FIG. 11, a thin, elongated and relatively flexible strip of synthetic resin sheet material is thermoformed to provide a pair of upstanding platform sections generally designated by the numeral 12 and a spacer or spine section 14 therebetween. Each platform member 12 is comprised of a generally rectangular sidewall 16 with a peripheral flange 18 extending about the lower end of three sides thereof with the spacer or spine section 14 constituting an extension of the flange 18. The platform members 12 have a top wall 20 extending thereacross and in which are formed a multiplicity of pockets 22 each providing a recess which is configured and dimensioned to receive snugly therewithin a particular tool or related item. The sidewalls of the pockets 22 have inwardly projecting bosses 26 formed thereon which will frictionally engage or overlie the tools or items disposed therewithin to retain them securely and minimize rattling or relative motion.

The top wall of the platform member 12*b* has an upstanding rib 28 which extends about its periphery in part as an extension of the sidewall 16, and the platform section 12*a* has an upstanding rib 30 which is spaced inwardly from the periphery of the top wall 20 and its sidewall 16 so as to interfit frictionally within the rib 28 of the platform member 12*b*. Spaced bosses 32 are provided on the inside surface of the rib 28 and seat in recesses 34 formed in the outer surface of the rib 30 so as to enhance the frictional engagement between the two platform members in the closed position of the tool case.

Underlying the top wall 20 of each platform member 12*a*, 12*b* is a relatively rigid support member 36 which substantially fills the cavity defined within the platform member 12 and which has recesses 38 in its upper surface closely conforming to the inner surfaces of the walls defining the pockets 22. Thus, the support members 36 provide the structural strength necessary to support and firmly retain the tools received in the pockets 22.

Underlying the support members 36, the flanges 18, and the spacer section 14, is the base sheet member generally designated by the numeral 40 and which has score lines corresponding to the lines 42 in FIG. 11 to permit its folding thereabout. Underlying the base sheet member 40 is a resiliently deformable synthetic resin cushion member 44 which underlies the major area of the platform members 12, but which terminates inwardly from the peripheral margins of the flange 18.

A continuous fabric or textile cover 46 extends over substantially the entire surface of the base sheet member 40 and cushion member 44 to closely adjacent the edge of the flange 18 of the liner member 10. Bias woven edge tape 48 is wrapped around the edges of the flange 18, and the entire structure is sewn together through the edge tape 48 to secure the several members in assembly, with the stitching being designated by the numeral 50 in several of the figures.

As illustrated, the tool case includes a pocket 52 formed by a separate piece of fabric sewn to the exterior surface of the fabric cover 46 underlying the platform member 12*b*, and this pocket has a transversely extending opening adjacent the upper end thereof which is releasably closed by the zipper 54 or other suitable closure means.

A second pocket 56 is provided on the other principal surface of the tool case by sewing another layer of fabric to the fabric cover 46, and this pocket is open along its upper edge. A releasable closure to hold the upper edge of the pocket against the underlying fabric cover 46 is provided by strips of interfitting microloops such as the product sold under the trademark VELCRO.

Figure 1:
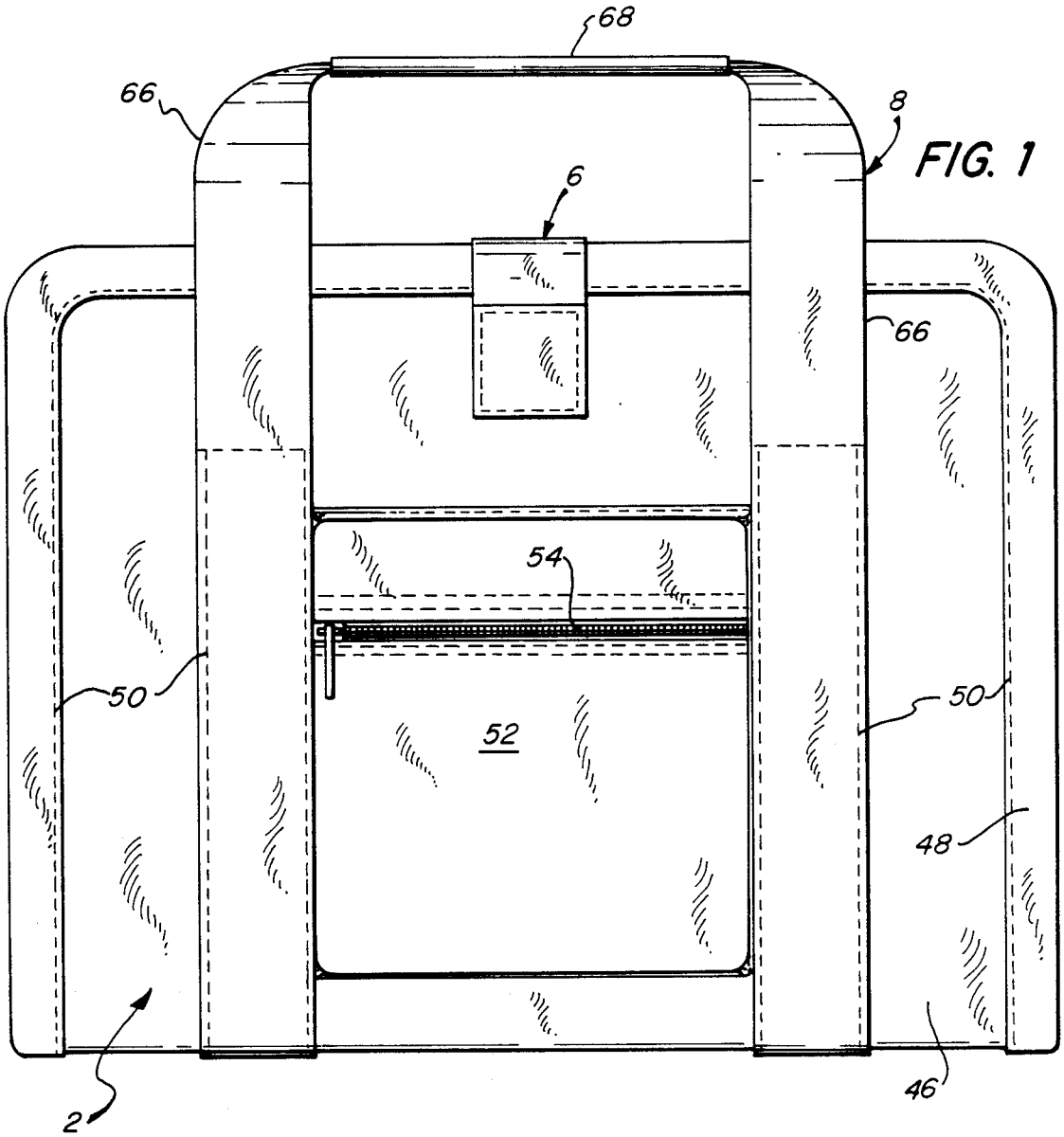
FIG. 1 is a front elevational view of a tool case embodying the invention.
Figure 2:
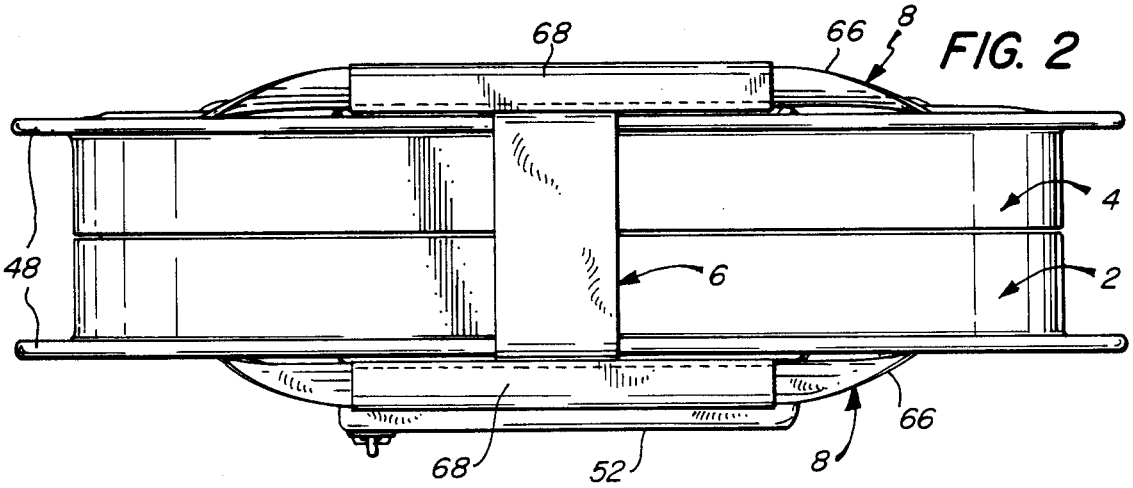
FIG. 2 is a top plan view thereof.
Figure 3:
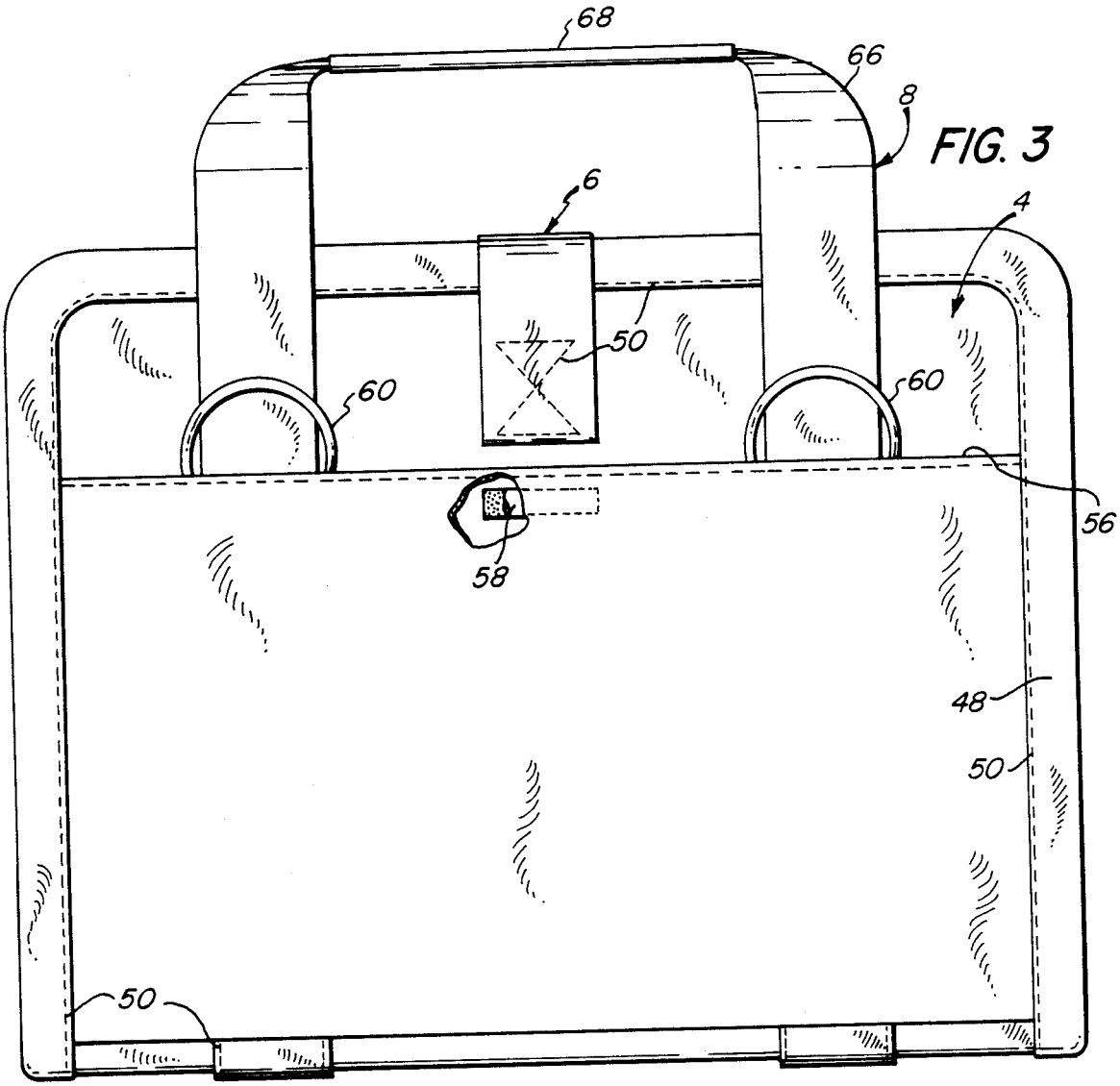
FIG. 3 is rear elevational view thereof with the hanging rings in the extended position and with a portion of the pocket broken away to illustrate the closure assembly.
Figure 4:
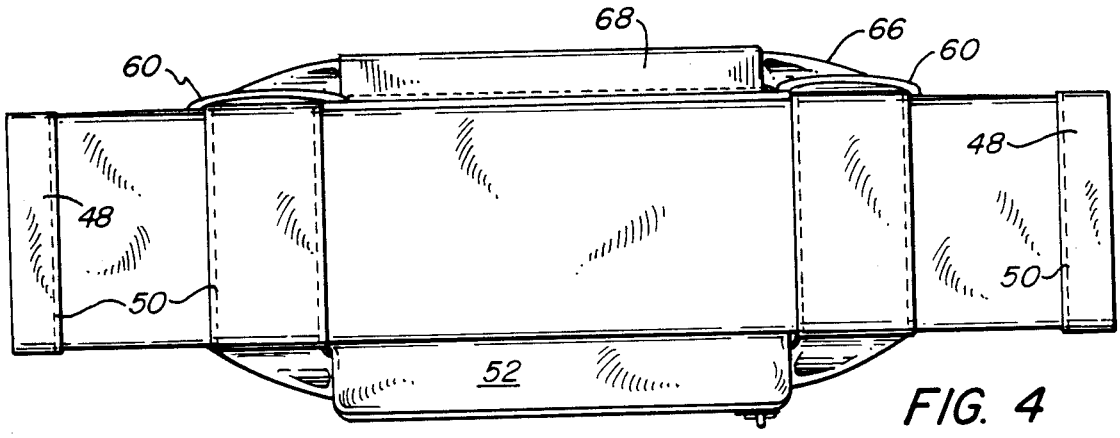
FIG. 4 is a bottom view thereof.
Figure 7:
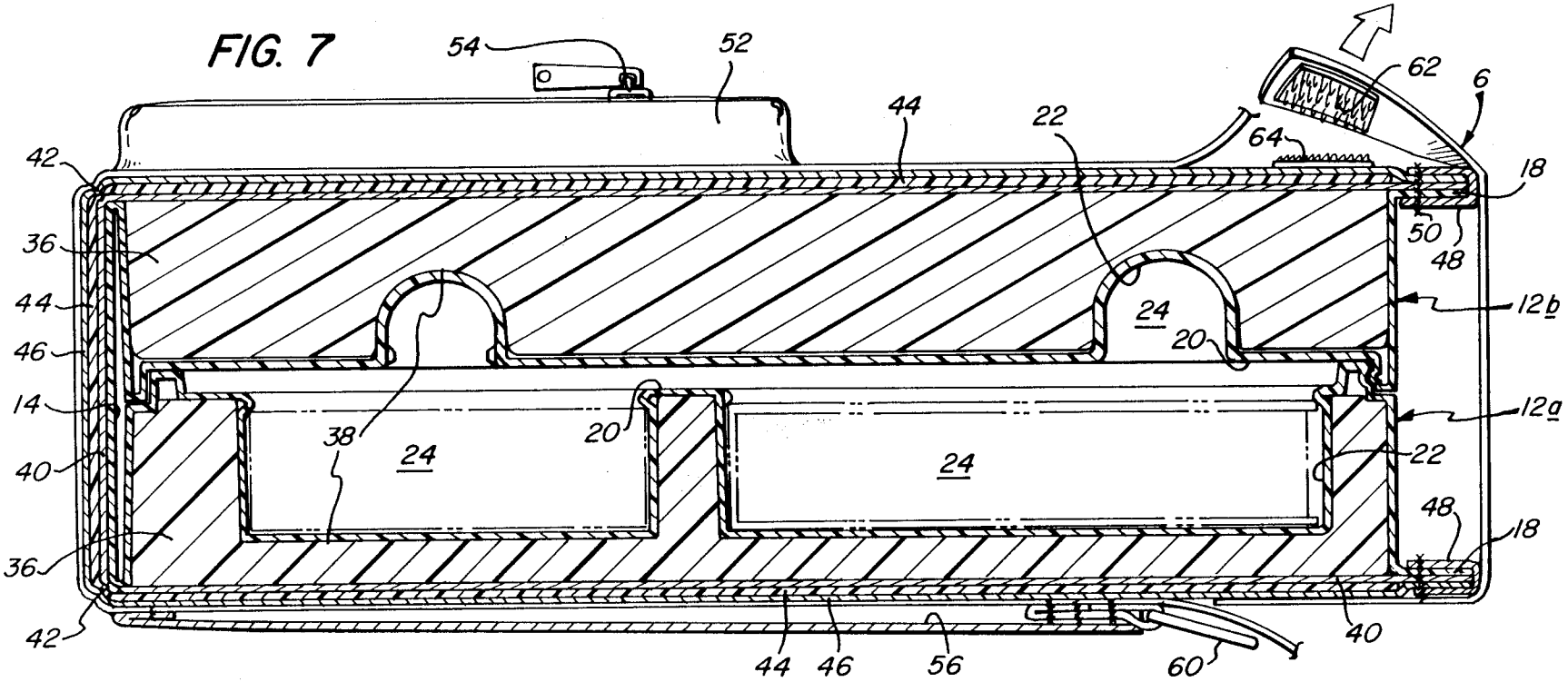
FIG. 7 is a transverse cross sectional view of the tool case drawn to an enlarged scale and with the closure shown in the opened position and with portions of the handles broken away.
Figure 10:
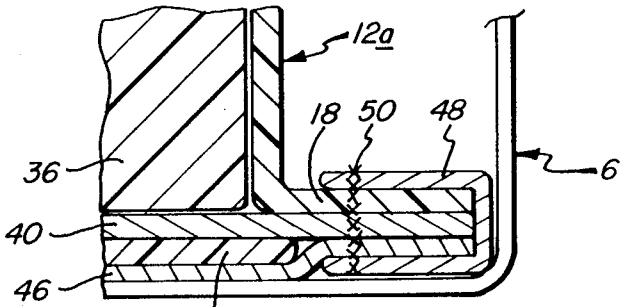
FIG. 10 is a fragmentary sectional view to an enlarged scale showing the several layers of the composite structure adjacent the right hand lower end of the tool case as seen in FIG. 7.
Figure 9:
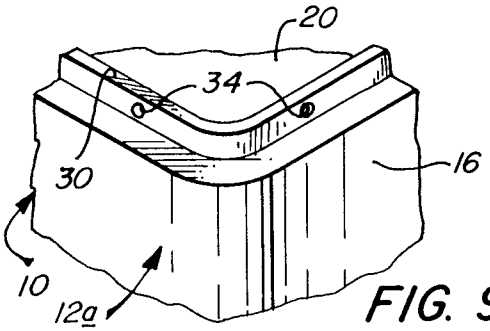
FIG. 9 is a fragmentary perspective view to an enlarged scale of the rib on one of the platform members.
Figure 8:
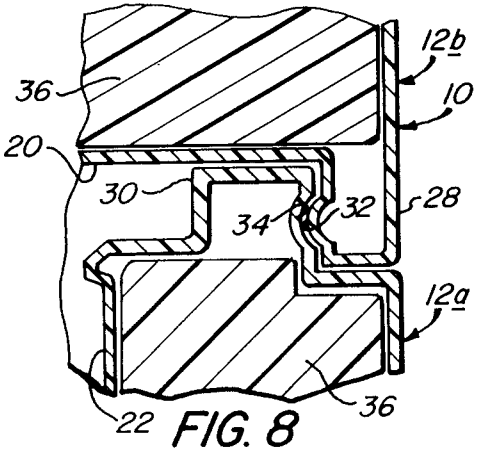
FIG. 8 is an enlarged fragmentary cross sectional view of the interfitting ribs on the platform members.

A pair of rings 60 are pivotably secured to the inside surface of the fabric layer providing the pocket 56, and these rings may be pivoted from the upwardly extended and exposed position shown in FIG. 3 to a concealed position wherein they are disposed within the pocket 56. For hanging the tool case on hooks or nails, these rings 60 are extended and conveniently utilized.

Turning now to the handles 8, these are generally comprised of a continuous length of web-type strap 66 which is sewn to the fabric cover 46 so as to form two U-shaped loops extending above the closed, abutting platform sections 12. The strap 66 extends under the fabric providing the pocket 56, about the spacer section 14, and along the sides of the pocket 52. Sewn about the center of the upwardly projecting loops are leather or vinyl grips 68 to provide comfortable gripping surfaces, durability and resistance to soiling.

The fastener assembly 6 conveniently comprises a length of strap 62 sewn to the fabric cover underlying the platform member 12*a* and extending about the upper end of the closed case. Adjacent its free end, the strap 62 has a VELCRO hook fastener 64*a* which cooperates with a mating VELCRO loop fastener 64*b* sewn to the fabric cover 46 underlying the platform member 12*b*

As suggested by the configuration of the pockets illustrated in FIG. 11, these may vary widely depending upon the nature of the tools to be stored therein. For example, in the platform member 12*b* a relatively large pocket is shown for a hammer. Conveniently, other pockets in the platform member would be configured and dimensioned to receive a needlenose pliers, conventional pliers, an adjustable wrench, scissors and a utility cutting knife. The relatively large rectangular pocket shown in the platform member 12*a* is of a type which would receive a plastic case containing a variety of fasteners and optionally a small "how to" booklet. In addition, the platform member 12*a* can conveniently include several pockets for different types and sizes of screwdrivers, for glue, for a coilable measuring rule, and for electrical tape. The choice of the configuration and size of the pockets will of course depend upon the type of tools or wish to be included in the case.

Depending upon the size of the pocket and the weight of the tool, the number of retainer bosses about the pocket will vary. Generally, elongated bosses of the type illustrated function quite effectively because of the area of frictional engagement provided. In some instances, the bosses may overlie the tool in the pocket.

As indicated in the drawings, the platform members are conveniently formed as a part of an integral liner having a desired surface appearance since the sides thereof will provide the sides and top of the tool case in its closed position. For this purpose, polyvinyl chloride, polyethylene, polypropylene and other resins providing relatively flexible sheeting which will provide self-hinging or folding about the fold lines for the spacer section are desirably employed. In practice, polyvinyl chloride resin sheet material having a thickness of about 0.025–0.045 inch is quite satisfactory. Such sheeting may be readily thermoformed to provide the upstanding platform members and the pockets. Alternatively, integral structures may be formed by injection molding and the like but at greater cost.

The support members underlying the platform members are conveniently and desirably formed from lightweight synthetic resin foamed structures conveniently of polystyrenes, polyurethanes, or polyvinyl chloride. The foamed structure may be formed by molding, by foaming in place or by die cutting from blocks of sheet material.

The cushioning material which underlies the fabric covering may be selected from a variety of materials. However, open cell urethane sheeting has proven particularly advantageous in a thickness of approximately 0.10–0.15 inch. To enable the use of a continuous sheet of the cushioning material and facilitate its folding in the spacer section, the sheet material may be perforated along the intended fold lines to provide the ability to fold upon itself conveniently and easily.

The base sheet member may comprise plastic sheeting, paperboard, or laminates thereof. In practice, cardboard of 0.030—0.050 inch thickness has been quite satisfactory in providing beneficial strength to the assembly while not unduly limiting the ability to stitch through the several layers.

Similarly, the fabric covering may vary quite considerably, and synthetic fibers may be employed as well as natural fibers. A highly attractive appearance and one which is readily cleaned is provided by a tightly woven cotton duck fabric. The fabric may also be provided by synthetics such as nylons, acrylics and polysters, and its thickness, density and finish may vary to provide the feel or hand desired for the fabric.

The binder tape should be one which is bias woven so that it will readily wrap around the curves provided at the outer corners of the flanges. Conveniently, this tape is fabricated from polyester resin to provide durability and scuff resistance.

As indicated above, the several layers are sewn together along the flanges to retain the components in assembly, and a high strength thread is utilized for this purpose. Similarly, the pockets and straps are sewn to the fabric cover.

The straps are desirably of a high strength woven cotton or synthetic fabric, and leather or vinyl grips are sewn thereto for ease of handling The closures for the pockets and for the case may assume various forms, including snaps, pivotable grommets, zippers, microloops, etc.

Although not absolutely essential, it is desirable to adhesively bond the liner to the base sheet and the fabric to the base sheet, and the cushioning material to the base sheet, at least at spaced points, so as to minimize any tendency for the material to creep or sag and to facilitate the assembly operation. As may be seen from FIGS. 1–6, the assembled case is one which presents a highly desirable appearance with the two principal faces being fabric covered. Moreover, the cushioning material underlying the fabric gives a very soft touch or feel to these faces, and it enhances the quality image of the product. The side and top faces of the closed structure are provided by the liner member which is desirably of a high quality resin so as to have a coloration and finish which blends well with the fabric covering.

Thus, it can be seen that the novel fitted tool case of the present invention is one which enables storing of a variety of tools and which is attractive in appearance and lightweight for transport purposes. The tools are releasably retained within the pockets in the platform members. The several components may be readily fabricated and readily assembled, and the resultant assembly is one which is relatively durable. The outer fabric covering and soft feel provide the principal surfaces of the case and are highly attractive to make it acceptable in a variety of social settings.

Having thus described the invention, what is claimed is:

1. A fitted tool case comprising:

(a) a pair of synthetic resin platform members each having a peripheral sidewall, a base flange about the lower end of said sidewall, and a transverse top wall extending across the top of the cavity peripherally defined by said sidewall, said top wall having a multiplicity of depending pockets formed therein providing recesses configured and dimensioned to snugly receive a multiplicity of tools;

(b) a pair of support members of relatively rigid material seated snugly within each of said cavities of said platform members, said support members having recesses in their upper surfaces closely conforming to the pockets of said platform members to provide support therefor;

(c) an elongated base sheet member underlying said platform members and extending therebetween to provide a spacer section, said platform members being secured to the inner surface of said base sheet member and being spaced apart thereon a distance substantially equal to the combined height of the two platform members to permit said base sheet member to be folded about said spacer section to dispose said platform members in abutting relationship;

(d) a fabric covering on the outer surface of said base sheet member;

(e) means securing said fabric covering, platform members and base sheet member in assembly;

(f) releasable closure means to secure said tool case in closed position with said platform members in abutting relationship; and (g) handle means for carrying said tool case.

2. The fitted tool case in accordance with claim 1 wherein a length of relatively thin and flexible synthetic resin sheet material is integrally formed to provide said platform members and a spacer section extending therebetween and overlying said spacer section of said base sheet member.

3. The fitted tool case in accordance with claim 1 wherein said top walls of said platform members have upstanding ribs extending peripherally thereabout which interfit in the abutting relationship thereof to effect functional engagement in the closed portion of the tool case.

4. The fitted tool case in accordance with claim 3 wherein the opposed surfaces of said upstanding ribs have cooperating detents and bosses which frictionally engage in the abutting relationship of said platform members to provide releasable retention means.

5. The fitted tool case in accordance with claim 1 wherein said pockets in said top walls of said platform members have base walls and sidewalls, and wherein said pocket sidewalls have laterally inwardly projecting bosses to frictionally engage or overlie the tools seated therein for retention thereof within the pockets.

6. The fitted tool case in accordance with claim 1 wherein said tool case additionally includes a resiliently deflectable cushioning member disposed between said base sheet member and fabric member at least in the areas underlying said platform members to provide a relatively soft feel to the faces of said tool case.

7. The fitted tool case in accordance with claim 1 wherein said handle members comprise fabric straps secured to the fabric covering underlying each of said platform members and extending thereabove in the closed position of said tool case to provide a facile means for carrying said tool case.

8. The fitted tool case in accordance with claim 1 wherein said tool case includes at least one pocket secured to said fabric covering underlying one of said platform members, said pocket having an opening adjacent its end spaced in the direction away from said spacer section, and closure means for said pocket.

9. The fitted tool case in accordance with claim 1 wherein said tool case includes a pocket underlying each of said platform members disposed on said fabric covering, said pockets having an opening adjacent the end spaced from said spacer section, and releasable closure means for closing said opening of said pocket.

10. The fitted tool case in accordance with claim 9 wherein one of said pocket members has the opening extending across its upper end, and wherein a pair of hanging rings are pivotally mounted in said pocket adjacent said opening for pivoting between a first position disposed within said pocket and a second position in which they extend upwardly therefrom for hanging said tool case upon a supporting structure.

11. The fitted tool case in accordance with claim 1 wherein said means for scouring said fabric covering, platform members and base sheet member in assembly comprises stitching extending therethrough.

12. A fitted tool case comprising:

(a) an integrally formed liner member providing a spaced pair of synthetic resin platform members and a spacer section therebetween, each platform member having a peripheral sidewall, a base flange about the lower end of said sidewall, and a transverse top wall extending across the top of the cavity peripherally defined by said sidewall, said top wall having a multiplicity of depending pockets formed therein providing recesses configured and dimensioned to snugly receive a multiplicity of tools;

(b) a pair of support members of relatively rigid material seated snugly within each of said cavities of said platform members, said support members having recesses in their upper surfaces closely conforming to the pockets of said platform members to provide support therefor;

(c) an elongated base sheet member underlying said platform members and extending therebetween to provide a spacer section, said platform members being secured to the inner surface of said base sheet member and being spaced apart thereon a distance substantially equal to the combined height of the two platform members to permit said base sheet member to be folded about said spacer section to dispose said platform members in abutting relationship;

(d) a fabric covering on the outer surface of said base sheet member;

(e) a resiliently deflectable cushioning member disposed between said base sheet member and fabric member at least in the areas underlying said platform members to provide a relatively soft feel to the faces of said tool case;

(f) means securing said fabric covering liner, and base sheet member in assembly;

(g) releasable closure means to secure said tool case in closed position with said platform members in abutting relationship; and (h) fabric strap handle members secured to the fabric covering for each of said platform members and extending thereabove in the closed position of said tool case to provide a facile means for carrying said tool case.

13. The fitted tool case in accordance with claim 12 wherein said top walls of said platform members have upstanding ribs extending peripherally thereabout which interfit in the abutting relationship thereof to effect functional engagement in the closed position of the tool case.

14. The fitted tool case in accordance with claim 13 wherein the opposed surfaces of said upstanding ribs have cooperating detents and bosses which frictionally engage in the abutting relationship of said platform members to provide releasable retention means.

15. The fitted tool case in accordance with claim 12 wherein said pockets in said top walls of said platform members have base walls and sidewalls, and wherein said pocket sidewalls have laterally inwardly projecting bosses to frictionally engage or overlie the tools seated therein for retention thereof within the pockets.

16. The fitted tool case in accordance with claim 12 wherein said tool case includes at least one pocket secured to said fabric covering underlying one of said platform members, said pocket having an opening adjacent its end spaced in the direction away from said spacer section, and closure means for said pocket.

17. The fitted tool case in accordance with claim 12 wherein said tool case includes a pocket underlying each of said platform members disposed on said fabric covering, said pockets having an opening adjacent the end spaced from said spacer section, and releasable closure means for closing said opening of said pocket.

18. The fitted tool case in accordance with claim 17 wherein one of said pocket members has the opening extending across its upper end, and wherein a pair of hanging rings are pivotally mounted in said pocket adjacent said opening for pivoting between a first position disposed within said pocket and a second position in which they extend upwardly therefrom for hanging said tool case upon a supporting structure.

19. The fitted tool case in accordance with claim 12 wherein said means securing said fabric covering, base sheet member and liner in assembly comprises stitching extending therethrough.

* * * * *

UNITED STATES PATENT AND TRADEMARK OFFICE

CERTIFICATE OF CORRECTION

PATENT NO. : 4,836,374

DATED : June 6, 1989

INVENTOR(S) : Walter J. Hutchins and Randall K. Cooper

It is certified that error appears in the above-identified patent and that said Letters Patent is hereby corrected as shown below:

Column 7, line 58, "scouring" should be -- securing --.

Signed and Sealed this

Tenth Day of April, 1990

*Attest:*

HARRY F. MANBECK, JR.

*Attesting Officer*

*Commissioner of Patents and Trademarks*